United States Patent [19]

Phillips

[11] Patent Number: 4,731,964

[45] Date of Patent: Mar. 22, 1988

[54] STEEL SHELL BUILDING MODULES

[76] Inventor: Edward H. Phillips, 3601 Bay Shore Rd., Fort Collins, Colo. 80524

[21] Appl. No.: 67,872

[22] Filed: Jun. 30, 1987

Related U.S. Application Data

[63] Continuation-in-part of Ser. No. 852,021, Apr. 14, 1986, Pat. No. 4,677,798.

[51] Int. Cl.[4] ..... E04H 3/08

[52] U.S. Cl. ..... 52/106; 52/79.4; 52/79.9; 52/144; 52/404; 109/79

[58] Field of Search ..... 52/79.1–79.12, 52/106, 144, 238.1, 243, 404; 109/78, 79

[56] References Cited

U.S. PATENT DOCUMENTS

| | | | |
|---|---|---|---|
| 1,100,804 | 6/1914 | White . | |
| 2,482,624 | 9/1949 | Korman . | |
| 2,717,664 | 9/1955 | Grafman . | |
| 2,744,589 | 5/1956 | Jenkins et al. . | |
| 2,901,781 | 9/1959 | Sha'ag . | |
| 3,312,019 | 4/1967 | Faerber | 52/106 |
| 3,722,152 | 3/1973 | Schlatter et al. | 52/79 |
| 3,769,766 | 11/1973 | Speidel | 52/73 |
| 3,866,376 | 2/1975 | Nelsson | 52/493 |
| 3,899,043 | 8/1975 | Hall | 181/33 K |
| 4,316,351 | 2/1982 | Ting | 52/309.9 |
| 4,494,348 | 1/1985 | Kastelic | 52/588 |
| 4,677,798 | 7/1987 | Phillips | 52/106 |

*Primary Examiner*—J. Karl Bell

*Attorney, Agent, or Firm*—Laurence R. Brown; Alfred J. Mangels

[57] ABSTRACT

A building panel element formed from sheet steel and having a rectangular wall member and inwardly directed panels that extend along longitudinal edges of the rectangular member. A plurality of panel elements are positioned for end-to-end assembly with a plurality of corresponding panel elements positioned opposite thereto and spaced therefrom in staggered relationship to define a building module having spaced parallel faces and having one or more inner compartments defined by the inwardly directed panels. The inner compartments can be filled with insulating materials, concrete, rock, armor plate, and the like, as desired, to provide required module properties. Modules formed from such building panel elements can be prefabricated in a factory and carried to a building site for assembly either as individual elements, as prefabricated wall modules, or as prefabricated room modules.

39 Claims, 40 Drawing Figures

FIG. 1
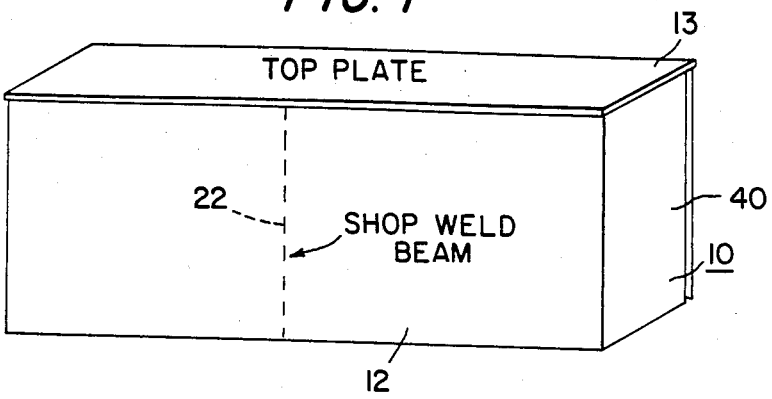
FIG. 3
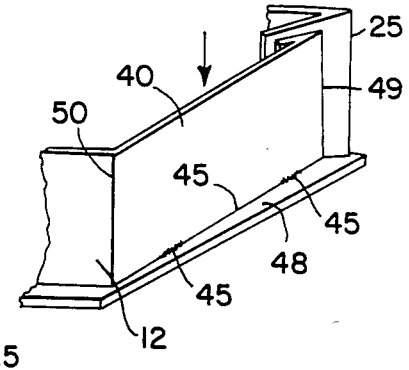
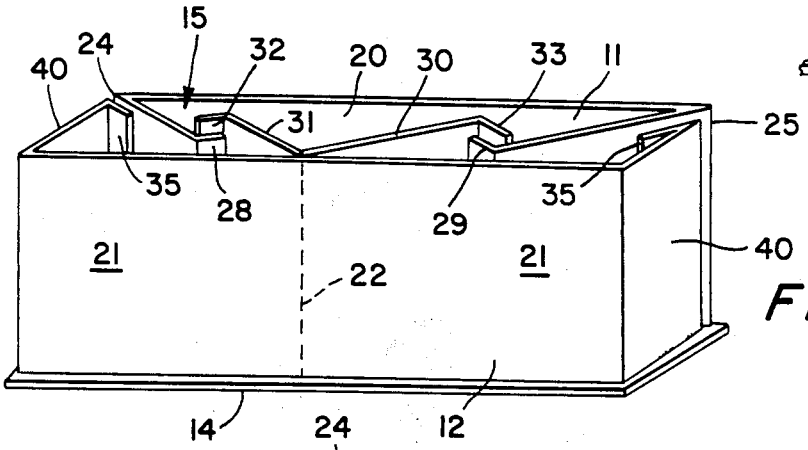
FIG. 2
FIG. 4
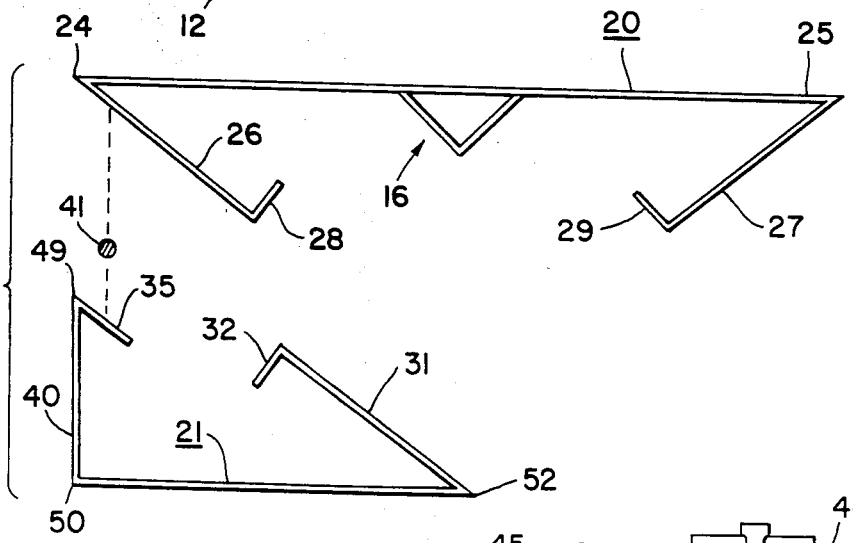
FIG. 5
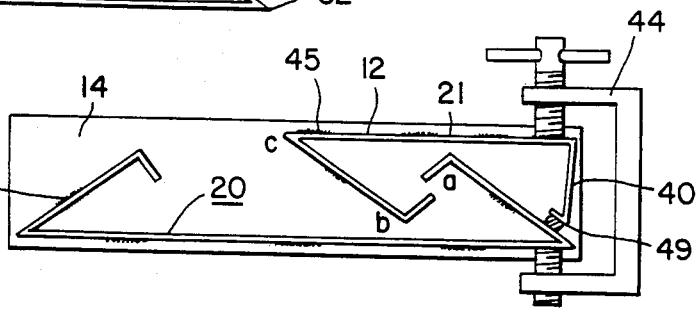

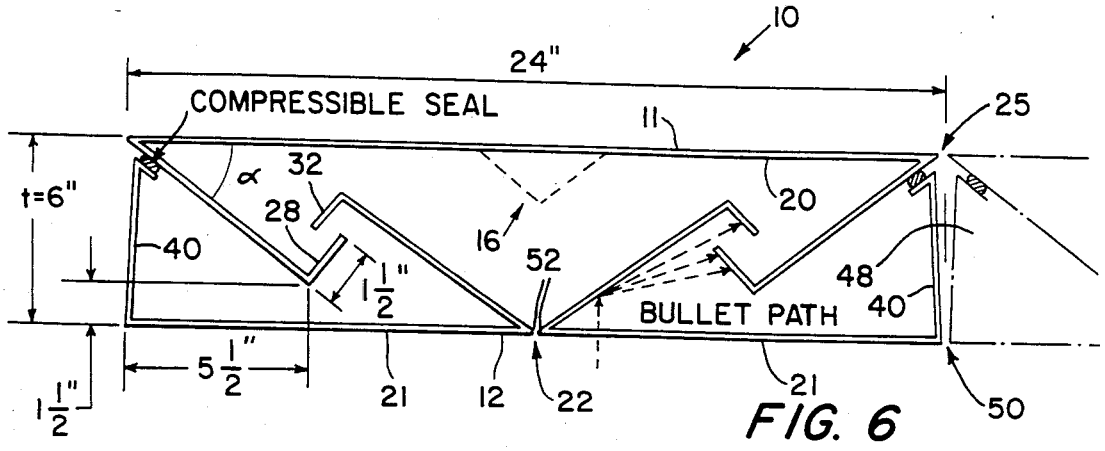
FIG. 6
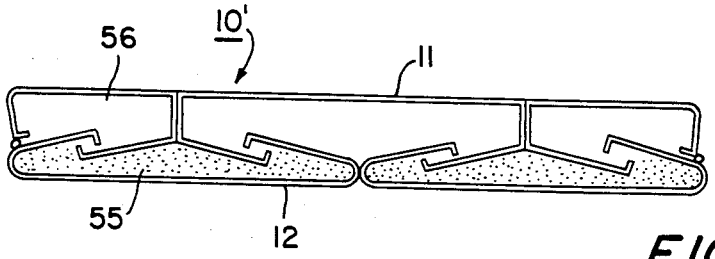
FIG. 7
FIG. 8
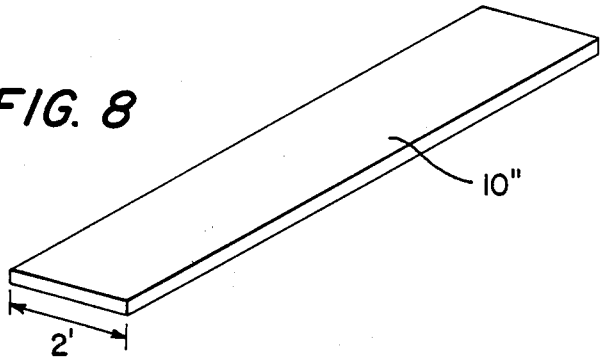
FIG. 10
FIG. 9
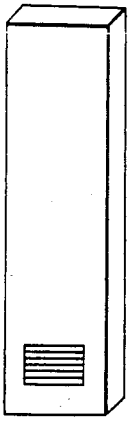
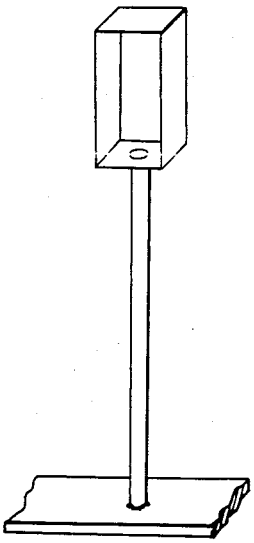
FIG. 11
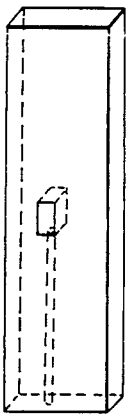

STEEL SHELL BUILDING MODULES

CROSS-REFERENCE TO RELATED APPLICATIONS

This is a continuation-in-part of copending application Ser. No. 852,021, filed Apr. 14, 1986 now U.S. Pat. No. 4,677,798.

BACKGROUND OF THE INVENTION

1. Field of the Invention

This invention relates to building modules, and more particularly it relates to steel shell building modules for forming the walls, floors, and roofs of buildings, parts of buildings, and other structures, such as barrier walls.

2. Description of the Related Art

Various types of modular building elements in the form of panels, walls, and the like have been disclosed. The advantages of such modular construction includes the ability to more rapidly erect a building and to provide modules that have desired structural and functional characteristics, depending upon the part of the building in which the module is to be installed, and the functional requirements of that part of the building or other structure.

Although building modules can take a number of different forms, and can be made from a variety of materials, metallic building modules and building module elements can provide desired degrees of load bearing capacity, fire resistance, sound and thermal insulation, projectile resistance, and the like. However, the prior art building modules and module elements have not been sufficient to simultaneously satisfy all those criteria. Accordingly, it is an object of the present invention to provide building module elements and building modules that provide desired strength, fire resistance, sound and thermal insulation, and security features.

The use of metallic panels to define building walls is known. For example, the disclosure of such wall panels has been made in U.S. Pat. No. 3,866,376, which issued in Feb. 18, 1975, to Nels Nelsson; in U.S. Pat. No. 2,717,664, which issued on Sept. 13, 1955, to A. J. Grafman; and in U.S. Pat. No. 4,316,351, which issued on Feb. 23, 1982, to Raymond M. L. Ting. However, those patents do not disclose the provision of hollow, metallic building modules that are intended to be load bearing interior and exterior wall, ceiling, floor, and roof structural members, and that also provide fire and projectile resistance for security enclosures.

SUMMARY OF THE INVENTION

Briefly stated, in accordance with one aspect of the present invention, a structural building panel element for forming a part of a building wall surface includes a metallic wall member having an inner wall surface and an outer wall surface, having a predetermined height and weight, and having longitudinal ends and lateral ends. A pair of laterally spaced baffle members each extending inwardly from respective ones of the longitudinal ends define an acute angle with the inner wall surface of the panel element. Each of the baffle members includes an inwardly extending end flange carried along the innermost edges of the baffle members, the end flanges being in opposed relationship relative to each other and facing the inner wall surface of the panel element.

In accordance with another aspect of the present invention, a building panel module is provided from a plurality of the structural panel elements described above. The panel module includes a pair of similarly configured end panel elements each having a first rectangular wall defining first inner and outer wall surfaces, the rectangular wall having a length and a width. A baffle member extends from a first longitudinal edge of the wall and is in overlying relationship with the first inner wall surface and is inclined at an acute angle thereto. An end member extends from a second longitudinal edge of the wall and in the same direction relative to the first inner wall surface as the baffle member. Each of the baffle member and the end member have longitudinally extending flanges that extend inwardly toward the first inner wall surface.

Additionally, a building panel module having at least one intermediate panel element can be provided. The intermediate panel includes a second rectangular wall defining second inner and outer wall surfaces, and a pair of laterally spaced, longitudinally extending baffle members connected to longitudinal edges of the second rectangular wall. The baffle members are in an overlying relationship with respect to the second inner wall surface and are inclined inwardly toward each other at an acute angle relative to the second wall surface. Each of the baggle members has longitudinally extending flanges that also extend inwardly toward the second inner wall surface. The end panel elements and at least one of the intermediate panel elements are positioned to define a panel module in which the first and second inner wall surfaces are in spaced, opposed relationship to define a panel module interior and are substantially parallel to each other. The end panel elements are disposed with corresonding first longitudinal edges in opposed relationship and with the end members facing outwardly, to define a portion of an end panel of the panel module, the first outer wall surfaces being substantially coplanar and defining at least a portion of a first outer wall surface of the panel module. The second outer surface of the intermediate panel defines at least a portion of the second outer wall surface of the panel module.

BRIEF DESCRIPTION OF THE DRAWINGS

FIGS. 1, 2, and 3 are perspective views of one form of building module construction in accordance with the present invention and showing a closed building module with one form of top plate, an assembled building module before a top plate is affixed, and an enlarged fragmentary end view, respectively.

FIG. 4 is an exploded plan view showing two shaped steel plate panel elements arranged in spaced relationship before being positioned closer together to form inner and outer wall panels of building modules in accordance with the present invention.

FIG. 5 is a plan view of an assembly jig used with the building module in an assembly step.

FIG. 6 is a plan view of an assembled building module in accordance with the present invention and identifying typical dimensions for one embodiment of the invention and also showing the end-to-end mating of a similar, adjacent module shown in phantom.

FIG. 7 is a sectional view through another form of building module in accordance with the present invention and showing an internal baffle arrangement that defines a series of interior compartments in which various filler materials can be deposited, and internally disposed insulation material in one series of compartments for one embodiment of a building module.

FIG. 8 is a perspective view of a roofing module.

FIGS. 9, 10, and 11 are perspective views of parts of a building module with utility accessories and air flow vent.

DESCRIPTION OF THE PREFERRED EMBODIMENTS

Figure 12:
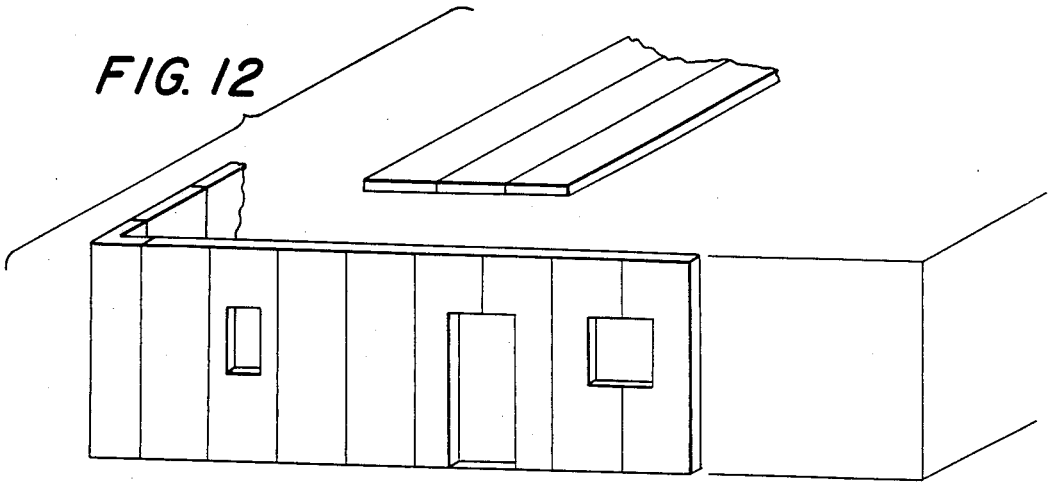
FIG. 12 is a perspective exploded view of a portion of a building, barrier wall, or security structure formed using building modules in accordance with the present invention.

As shown in the drawings, this invention provides building modules adapted to fit together for construction of fire-, heat-, sound-space and impact-resistant security barriers, walls, and rooms for use in securing contents, including records and persons, and for permitting rapid construction of ordinary buildings not requiring specific high security features. In particular, buildings, rooms, and parts thereof can be constructed on-site with prefabricated modules, with fewer field labor hours, with less-skilled labor, and with a minimum of special construction equipment. In addition to conventional building uses, such modules can also be assembled to provide special buildings and rooms having high security requirements, such as jail cells, protection barriers, and security storage vaults.

As used herein, the term "module" refers to a portion of a building or a wall structure. A module is formed by assembling a plurality of individual panel elements to form a module having a desired width, such as 1 foot, 2 feet, 3 feet, 4 feet, or the like. A plurlaity of modules placed side-to-side in the widthwise dimension can define either a complete wall, a portion of a wall, a complete floor or ceiling, or a portion of a floor or ceiling, depending upon the structural and functional requirements of the structure.

Referring to FIGS. 1 and 2, the module 10 has an outer steel shell to define a building structural panel. The module is of substantially parallelpiped shape with two spaced, substantially parallel outer steel plate face panel sections 11, 12 of predetermined dimensions and surface area to serve as inner and outer wall surfaces for a wall, ceiling, floor, or other portion of a structure when a plurality of the modules are fitted together. Top and bottom plates 13, 14 are provided for each longitudinal end of the modules.

To increase the load bearing capacity and to permit the individual steel plate panels to be of relatively small gauge, for example, 12 or 14 gauge steel plate, reinforcing members are disposed inside the module for increasing its load bearing capacity. The reinforcing members can include, at least in part, inwardly directed steel reinforcing baffles 15, 16, shown in FIGS. 2 and 4, respectively. Also, filler materials of various types and useful for other purposes, such as sound and thermal insulation, can keep the steel panels from buckling, and rigid fillers, such as hardened concrete, gypsum, or the like, can add considerable strength to the modules. Such fillers can be deposited within the modules either on-site or off-site, as desired.

The modules are constructed not only for ease in prefabrication, but for ease in on-site assembly in the field. Thus, with particular reference to FIGS. 2 and 4, it may be seen that each module has its vertical side and end walls formed from two forms of standard panel sections 20 and 21. Panel section 21 has a narrower width than panel section 20, preferably one half that of the wider panel section. In panel section 20 as illustrated in FIG. 4, load bearing, intermediate reinforcing baffles 16 can optionally be used with longer panels, with wider panels, or with panels having smaller wall thicknesses. As shown in FIG. 2, narrower panel sections 21 are joined together along respective longitudinal edges to meet at a center weld seam 22.

The wider panel sections 20 have a cross-sectional shape defined substantially by the base and two partial legs of a triangle, in which the legs form acute angles with the base and define apex points at opposite lateral ends 24, 25 of the panel section. This panel section structure provides integrally attached, inwardly extending baffles 26, 27 that terminate in inwardly extending end flanges 28, 29. Thus the only welds in panel section 20 are those for attaching the strengthening triangular intermediate baffle 16, if it is used.

Referring once again to FIG. 2, longitudinally extending edges of two of the narrower panel sections 21 are butted together to define joint 22, with each narrow panel extending substantially half the transverse width of the side panel 11 of the wider panel 20. Narrower panel sections 21 also include internally directed baffles 30, 31 and corresponding inwardly extending end flanges 32, 33. Additionally, narrow panel sections 21 also include inwardly extending flanges 35 provided along end walls 40, which end walls are at an angle of 90% or less relative to the outer face of side panel 12. The narrower panel sections 21 are of generally triangular cross section.

As best seen in FIG. 4, the two opposing panel sections 20, 21, are spaced from each other and are separated at their outermost ends by a sealing strip, such as glass fibre rope 41, or the like, which provides a thermal separation or break between panel sections 20 and 21. The sealing strip is compressed between the opposed faces of flange 35 and baffle 26, such as by means of the clamp 44 shown in FIG. 5. The panel sections 20, 21 are then welded in place to the bottom plate 14, such as at spaced welds 45. The sealing strip provides an insulating barrier to separate the adjacent portions of front and rear side panels 11 and 12 from direct steel-to-steel contact with each other by a suitable thermal-acoustical barrier material. Thus, transmission of sound, generated for example by impacts against the inner or outer wall surfaces, which would otherwise by transmitted by steel-to-steel contact to the other wall, is substantially restricted, as in the transfer of heat between the panels.

Referring now to FIGS. 3, 5, and 6, the module end walls 40 as shown are not perpendicular to the outer side panels 12, but define an acute angle therewith that is slightly less than 90%. Thus the inner apices 49 of the narrower panel sections 21 are displaced inwardly toward the center of the module from the panel ends 24 and 25 of the opposite wider panel section 20. As shown in FIG. 6, the end wall 40 thus is at an angle 48 of a few degrees. As a result, there is only line contact between adjacent narrower panel sections 21 along respective panel edges 50, and also only line contact between ends 24 and 25 of adjacent wider panel sections 20 when the modules 10 are assembled in end-to-end registration by welding two adjacent modules together, as seen at the right-hand end of FIG. 6, which shows the adjacent modules slightly separated just before they are welded together. Thus, only the weld joint 22 and the corresponding weld joints at the panel ends 25 and 50 need be finished by sanding, or the like, to provide smooth inner and outer wall surfaces.

FIG. 6 also shows preferred dimensions for module components that can be manually handled without special cranes or other on-site tooling, depending upon the density of any filler material disposed within the modules, except for appropriate welding apparatus. It is clear that the labor cost of the on-site assembly is minimal, and the use of pre-fabricated, factory-controlled module components made in accordance with this invention result in lower labor costs and permit buildings to be erected quickly.

An additional feature of the panel section construction in accordance with the present invention is that it gives additional protection against complete penetration of a module by ballistic projectiles, such as bullets. Thus, it may also be seen in FIG. 6 that if a bullet were to penetrate the outer steel shell wall 12, the angular disposition of the several inner baffles tends to deflect the bullet. The baffle structure then affords a higher degree of protection and permits the use of lighter gauge steel in the outwardly facing panels of the module. Note that even at the weld joint 22, which may of itself provide greater strength for stopping ballistic projectiles, if a bullet were to penetrate joint 22 directly, rear wall baffle 16 can serve as a deflector, as well as for structural reinforcement.

As may be seen from the module 10 illustrated in FIG. 6, as well as the module 10' illustrated in FIG. 7, the overlapping flanges 28 and 32, in the thickness direction of the module, provide for overlapping of the adjacent baffles to produce a discontinuous intermediate barrier wall between the opposite faces 11 and 12. The baffles and overlapped flanges also define interior compartments. Thus, filler materials, including two different types of insulation, if desired, can be provided in the compartments 55 and 56 of the module, as shown in FIG. 7, adjacent the opposite module outer walls. For example, in compartment 55 a mixture of gravel or river rock with gypsum will provide substantial additional resistance to bullet penetration and also good fire resistance. Compartment 56 could contain rock wool or another type of acoustic or thermal insulation. Accordingly, the module characteristics can be easily custom tailored for the specific needs of each installation.

In addition to the baffles and overlapping flanges defining compartments, during high longitudinal loading of a module or during exposure to high heat or fire, when outward bowing of the face panels of module is possible, the overlapped flanges tend to move outwardly along with the outwardly bowing face panel, and contact and interlocking of the flanges occurs to limit such outward bowing of the face panels and thereby preserve the structural integrity of the module.

Although building, rooms, cells, and individual barrier walls can be built primarily of the modules described hereinabove, a set of cooperating special purpose modules can also be provided for other building blocks, thus further contributing to lower cost and faster construction. For example, a top roofing member 10'' made in accordance with the present invention is show in FIG. 8.

For different security levels the plate wall thicknesses can be varied. Typically, 14 to 10 gauge steel can be used for reduced cost and weight, although steel plates of between 26 gauge and 7 gauge can also be used, if desired, or if required by structural strength or other considerations. The fillers can also contribute to strength and security. Thus, concrete or reinforced concrete can be used as a filler, or gravel with an epoxy binder can also be used. The hollow construction with suitable fillers permits the construction of secure rooms and building, and also provides spaces for utility passageways for connection with outlets typically as show in FIGS. 9 to 11. Suitably conditioned air passageways and electric outlets can be easily provided in this manner.

Figure 13:
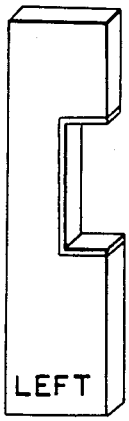
FIGS. 13 to 18 are perspective views of several different building modules in accordance with the present invention to provide openings, such as doors and windows, junctions, and corners in a wall structure.
Figure 14:
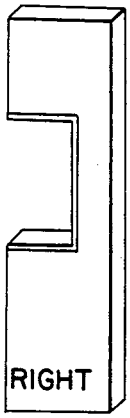
Figure 15:
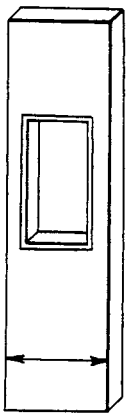
Figure 16:
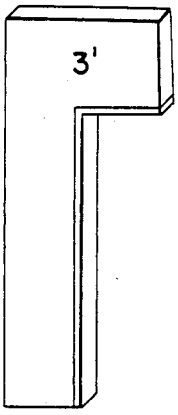
Figure 17:
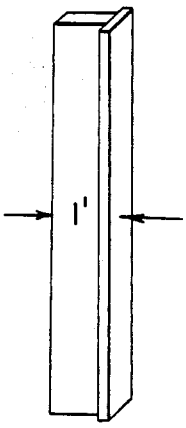
Figure 18:
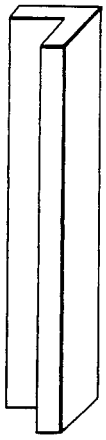

As seen in the building sketch of FIG. 12, provision can be made for doors and windows in walls formed from a plurality of connected modules. The special modules of FIGS. 13 to 18 can be made from panel sections in accordance with the present invention and can provide for matched registration in place in a building of compatible modules. Heavy steel plates can be provided along the edges of door openings for hanging doors, door strikes, and the like. Small windows, as in FIG. 15, can be installed in the field, or they can be pre-installed in a module at a manufacturing plant, and larger ones extending between adjacent modules, as shown in FIGS. 13 and 14, can be installed in the field by welding suitably shaped modules in place.

The walls of the building of FIG. 12 may be simple barrier walls used for security purposes. Thus the modular building construction afforded by this invention provides significant advantages wherever additional security must be provided. Typical wall characteristics include bullet and explosion resistance, fire and heat resistance, acoustic and thermal insulation, ease of manual assembly on site, and high structural strength. Thus the modules and modular construction of this invention can advantageously be employed to provide walls in jails, bank vaults, armories, firing ranges, embassy security areas, barrier walls, and military applications, as well as in special construction requiring unusual safety and strength, and also in conventional construction requiring thermal, noise and impact resistance, combined with architectural needs, sanitation, and ease of maintenance.

Figure 19:
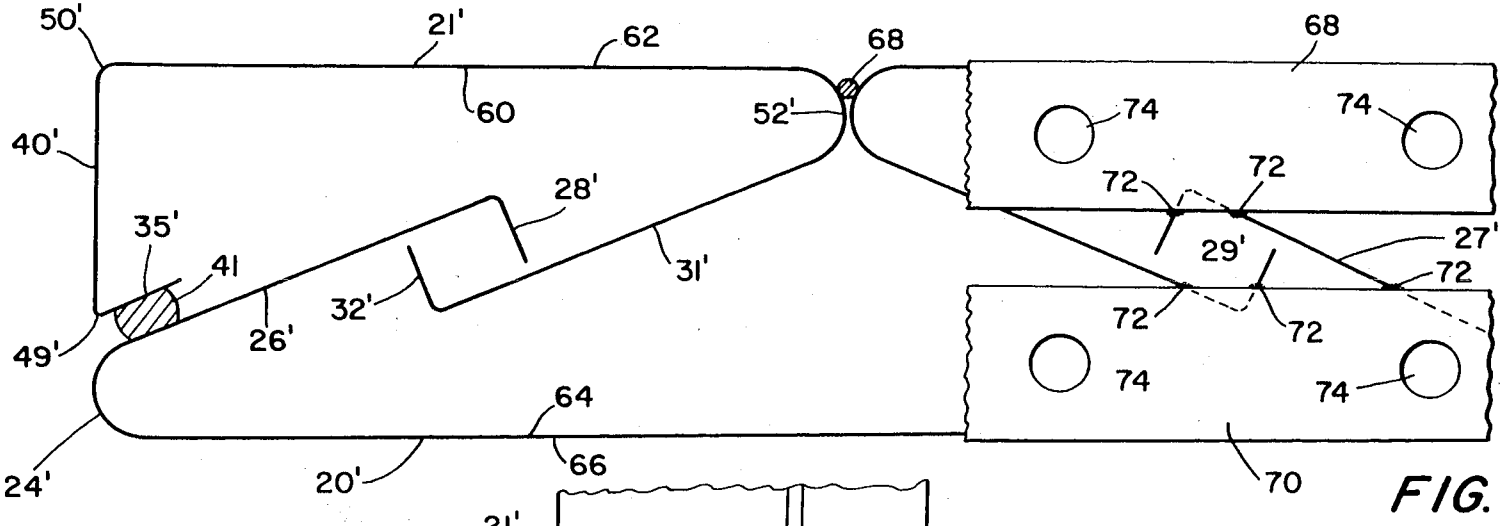
FIG. 19 is a plan view, partially broken away, of a module in accordance with the present invention showing panel elements with rounded ends and baffles at acute angles, together with a pair of spaced end plates.
Figure 21:
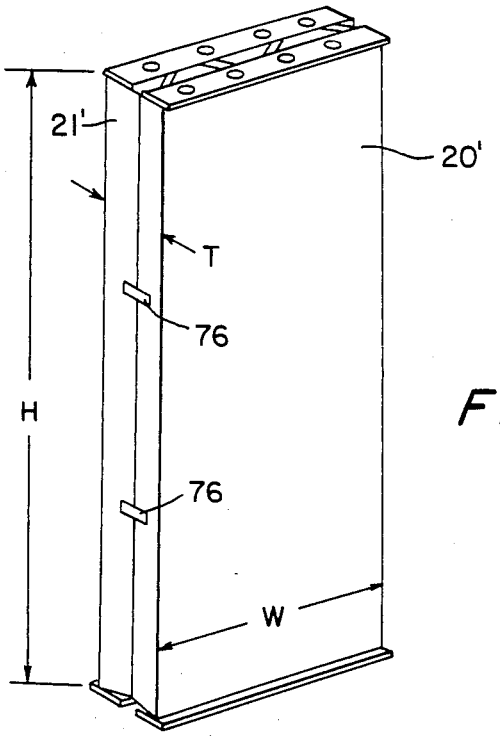
FIG. 21 is a perspective view showing an assembled building module that includes spaced connector plates welded to the inner and outer elements at different positions along the height dimension of the building module.

In FIG. 19 an additional embodiment of a modular wall panel construction is illustrated. The structure there shown is similar to that illustrated in FIG. 6, except that the respective longitudinally-extending edges of the various panel elements have a rounded configuration, rather than a sharp angle. As best seen in FIG. 21, the wall panel module has a width W in the transverse direction, a height H in the longitudinal direction, and a thickness T.

In particular, the end panel element 21' includes a first, generally rectangular wall that defines first inner wall surface 60 and first outer wall surface 62. The end panel element 21' includes a baffle member 31' that extends from a first longitudinal rounded edge 52', and is in overlying relationship with the first inner wall surface 60 and is inclined thereto at an acute angle, which is less than 45°, preferably less than about 30°, and most preferably within the range of from about 12°to about 30°. Baffle member 31' extends the entire height of the end panel element, and includes at its innermost longitudinally extending edge an end member in the form of an end flange 32', which preferably is disposed at a 90° angle to the baffle member, although other angular orientations can also be used, if desired. As shown, end flange 32' extends in a direction toward the inner wall surface 60 of the end panel.

An end wall panel 40' extends from the other longitudinal edge 50' of the first rectangular wall, to define a second rectangular wall. The angle formed between the first and second rectangular walls can be 90°, or it can be an acute angle of between about 80° and 90°, if desired, and if formed at such an angle less than a right angle, it permits line contact between adjacent panel modules along respective longitudinally-extending edges 50'. End wall panel 40' also has an inwardly extending end member or flange 35', which, as shown, can be oriented so as to be substantially parallel with baffle member 31'.

Figure 23:
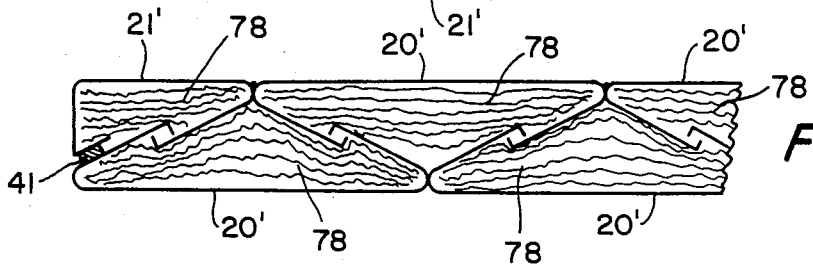
FIG. 23 is a fragmentary plan view of a structrual exterior wall panel module having angular baffles and including insulation batts positioned within the respective module elements.

Positioned opposite inner wall surface 60 of the end panel element 21' and substantially parallel thereto is an intermediate panel element 20', that is substantially symmetrical about a medial plane extending longitudinally therethrough and perpendicular thereto. Intermediate panel element 20' includes a second rectangular wall that defines second inner wall surface 64 and second outer wall surface 66, and also includes a pair of laterally spaced, longitudinally extending baffle members 26', 27' connected to respective longitudinal edges of the second rectangular wall. As is apparent from FIG. 19, baffle members 26', 27' are in overlying relationship with second inner wall surface 64, and are inclined toward each other at substantially equal acute angles, relative to second inner wall surface 64, the angles, again, being in the ranges pointed out above in connection with the discussion of the corresponding element in end panel sections 21'. Each of baffle members 26', 27' also includes longitudinally extending flanges 28', 29', respectively, that are directed inwardly toward second inner wall surface 64, and are perpendicular to respective baffle members 26', 27', although the flanges can be positioned at different angles relative to the baffle members, if desired. A wall panel module is formed by placing an end panel element 21' so that first inner wall surface 60 thereof is opposed to an substantially parallel to second inner wall surface 64 of intermediate panel element 20', with end wall 40' of end panel element 21' adjacent longitudinally extending outer edge 24' of the intermediate panel element. If a narrow panel module is desired, a second end panel element 21' is positioned adjacent the first end panel element 21', and in mirror image relationship thereto, and the two end panel elements 21 are welded together at weld 68 as shown, so that their respective outer wall surfaces 62 are parallel. The resulting building panel module is a relatively narrow one, and modules of different widths can be provided by placing one or more intermediate panels 20' in end-to-end relationship between end panel elements 21', such as illustrated in FIG. 23, with an end panel element 21' at each end of the module as the final panel element, in order to provide a wider panel module of substantially rectangular cross-section.

Figure 20:
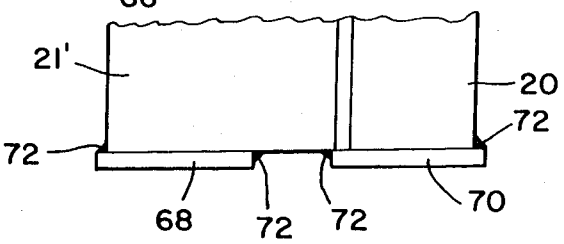
FIG. 20 is a fragmentary side view of the module of FIG. 19 showing the end plates at one side of the module, with the end plates welded to the edges of respective panel elements.

As shown in FIGS. 19 and 20, the respective panel elements 20' and 21' are connected to rectangular end plates 68, 70 by welds 22. The end plates are preferably substantially parallel to each other and are positioned at each longitudinal end of the module. The plates are spaced from each other in the thickness direction of the module, to reduce the thermal and acoustical paths between inner and outer panel elements, and also to reduce the weight of the module and to permit the introduction into the spaces defined by the end and intermediate panel elements of suitable insulation or other materials, as will hereinafter be described. Also as seen in FIG. 19, the rectangular end plates can also have spaced through openings 74, to further reduce the weight, and to further facilitate the placement within the module of suitable filler materials.

The longitudinally extending outer ends of the modules can includes a thermal rope 41, or the like, to provide thermal separation between the inner and outer surfaces of the module to minimize the transfer of heat from, for example, a colder outer or exterior surface to a warmer interior surface. Alternatively, if a thermal break between the respective inner and outer surfaces of the panel element is not necessary, the panel can be welded along that longitudinally extending junction, or, alternatively, and as illustrated in FIG. 21, the module can include a plurality of longitudinally spaced metallic connector plates 26 extending between and welded to end panel element 21' and to the opposite intermediate panel element 20', to provide a smaller thermal pathway between the inner and outer panel elements, and to effect connection therebetween and thereby strengthen the module and prevent buckling caused by large loads applied to the panel module structure in the longitudinal direction.

Figure 22:
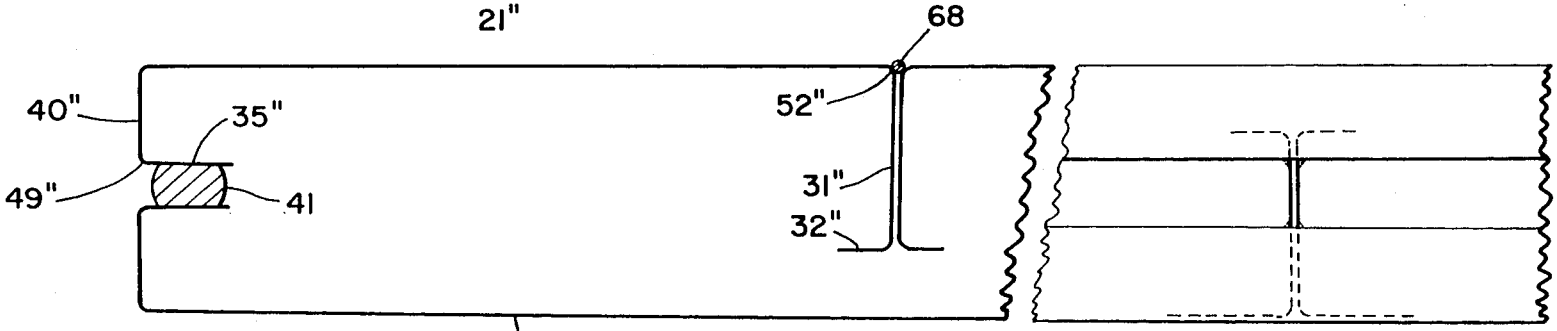
FIG. 22 is a fragmentary plan view similar to FIG. 19 of another form of building panel module showing panel elements having perpendicular ends instead of ends that extend at an acute angle to the inner and outer surfaces of the respective panel elements.

In FIG. 22 there is illustrated a similar wall panel module except that the respective panel elements 20", 21" from which the module is made are of generally rectangular configuration, without angularly inwardly extending baffles, for particular applications such as interior walls, which are, of necessity of smaller thickness than exterior walls. The respective panel elements have end walls 31", 40" that are parallel and at substantially right angles to the panel outer face, rather than the acute angle orientation in the FIG. 19 embodiment, but they are otherwise similar in construction and are assembled in the same manner to provide a completed module. However, the generally rectangular element modules define a single fill cavity, or compartment, rather than a series of substantially separate and discrete compartments as in the FIG. 19 embodiment.

Figure 22A:
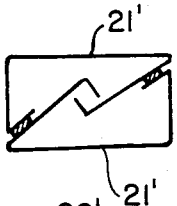
FIG. 22*a* is a plan view of a module in accordance with the present invention and formed by a pair of opposed end panel elements.

Another form of panel module is illustrated in FIG. 22*a*. That particular panel module incorporates a pair of end panel elements 21' that have their respective inner wall surfaces in opposed, spaced, substantially parallel relationship to define a panel module of narrow width. The end walls of the end panel elements are in opposed relationship, and the respective baffles and flanges are disposed as in the FIG. 19 embodiment.

Using end panel elements such as 21, 21', or 21" and intermediate panel elements 20, 20', or 20", respectively, individual modules of different thicknesses and width can be assembled, depending upon the structural and functional requirements of the module.

For example, a narrow width module formed by assembling two end panel elements is shown in FIG. 22*a*. Alternatively, a somewhat wider module can be formed from two end elements on the same face of the module, and an intermediate panel element defining the opposite face panel, as shown in FIG. 6. Moreover, even wider modules can be assembled using end panel elements oriented relative to each other as in the FIG. 6 embodiment, with any desired number of intermediate elements between them and an opposed array of intermediate panel elements. One such wider module is shown in FIG. 7, wherein the face 11 of the module is defined by two end panel elements and one intermediate panel element, and the face 12 of the module is defined by two intermediate panel elements. If desired, the FIG. 7 arrangement can be made wider by adding the same number of intermediate panel elements to each face to form the respective faces. Thus, as is apparent from the foregoing, face 11 can be defined by tw end panel elements and a predetermined number of intermediate panel elements, and face 12 can be defined by that same number of intermediate panel elements plus one.

As will be apparent to those skilled in the art, a wall formed from a series of modules configured only of end panel elements, such as the module shown in FIG. 22*a*, is considerably stronger, structurally, than is the same width wall formed from a series of modules configured such as the module shown in FIG. 7. Furthermore, for panel elements having the element configuration shown in FIG. 22, individual modules formed from two end panel elements, in the manner of the module shown in FIG. 22*a*, when used for floors or roofs, can support greater floor and roof loads because of the larger number of longitudinal stiffeners defined by adjacent end walls 31".

FIGS. 23 through 29 show a number of variations of panel modules that can be provided in accordance with the present invention, and using the panel elements illustrated in FIGS. 19 and 22. Although illustrated and described in terms of particular uses, it should be understood that the various module and panel configurations can be used interchangeably, if desired.

In the FIG. 23 embodiment, the interior spaces within the module include respective individual insulation batts 78 of rock wool, fiberglass, or the like. Such a module can be utilized for a structural wall intended either for interior use or for exterior use, and if the latter, suitable siding material can be applied to the outer surface, if desired, or the outer surface of the module can be painted with epoxy paint or any other desired finish.

Figure 24:
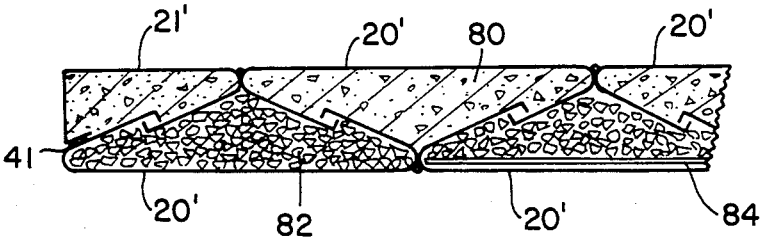
FIG. 24 is a fragmentary plan view of another form of structural exterior wall module intended for projectile or explosion resistance and suitable for use with security structures, or as wall panels for security areas of ordinary structures.

FIG. 24 shows a basic module structure similar to that of FIG. 23, having angularly extending baffles, but the filling material can be different in respective portions of the interior of the module. As shown, the compartments along one wall of the module are filled with concrete 80, whereas the compartments along the other wall surface are filled with loose rock 82 or gravel. Additionally, if desired from the standpoint of providing security against penetration of the module by ballistic projectiles, such as bullets or the like, an armor plate 84 can be provided adjacent one of the wall surfaces for additional resistance to penetration of the wall by ballistic projectiles or explosives.

Figure 25:
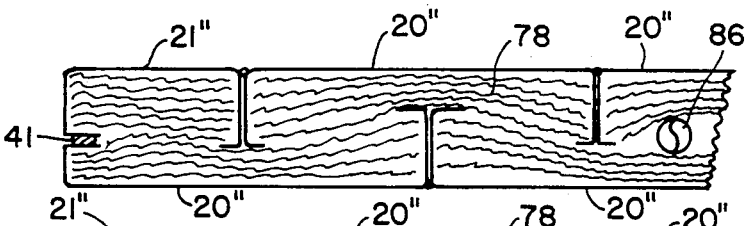
FIG. 25 is a fragmentary plan view of still another form of structural exterior wall panel module, having perpendicular ends and including internally positioned insulation batts.
Figure 26:
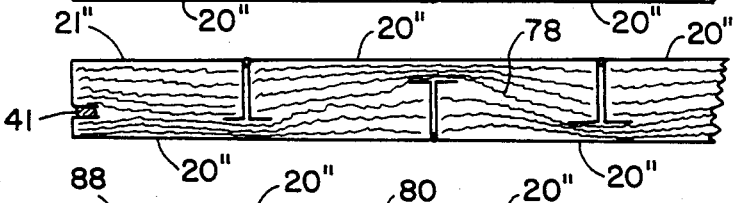
FIG. 26 is a fragmentary plan view of a structural interior wall panel module, similar to the exterior wall panel module of FIG. 25 but thinner, and that also includes internally positioned insulation batts.

The embodiments illustrated in FIGS. 25 and 26 are similar to FIG. 22 in terms of the basic panel element configuration, except for the thickness of the panel modules, and also except for the fact that the FIG. 25 embodiment includes an interiorly positioned utility duct 86. Otherwise, the respective modules can be filled with insulation batts, as in the FIG. 23 embodiment, with the FIG. 25 embodiment being particularly suitable for an interior or exterior structural wall or a ceiling panel, and the FIG. 26 embodiment being particularly suitable for an interior structural wall or a partition.

Figure 27:
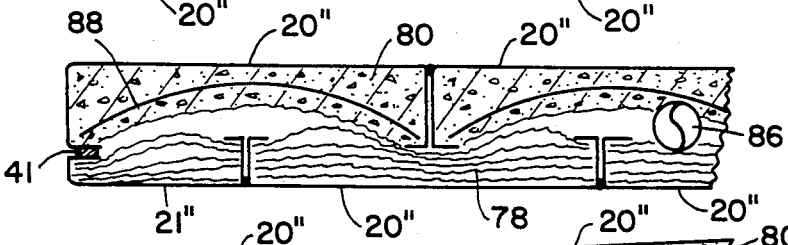
FIG. 27 is a fragmentary end view of a floor panel module incorporating concrete within the panel elements on one inner surface thereof and thermal insulation batts on the other inner surface thereof and showing a utility duct within the module.

In FIG. 27, a wall module having basic panel elements similar to those illustrated in FIG. 25 is shown, except that lightweight concrete 80, or gypsum or other appropriate fill, is provided adjacent one of the inner wall surfaces of the module, with suitable reinforcement in the form of welded wire fabric 88, or the like, if desired. As shown, the filling material need not fill the entire interior of panels 20". The opposite inner wall surface has positioned thereagainst insulation batts 78 of the type utilized in the embodiment of FIG. 25. The FIG. 27 embodiment is particularly suitable for providing a floor module.

Figure 28:
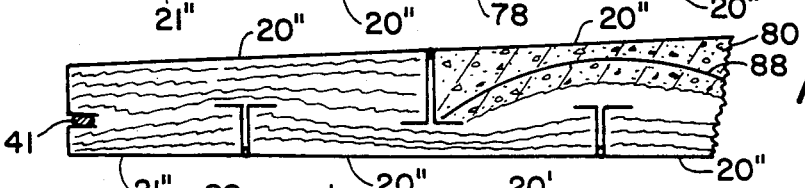
FIG. 28 is a fragmentary end view of a combined ceiling and roof module wherein the panel elements have parallel ends, and one face of the module is sloped relative to the other face.
Figure 29:
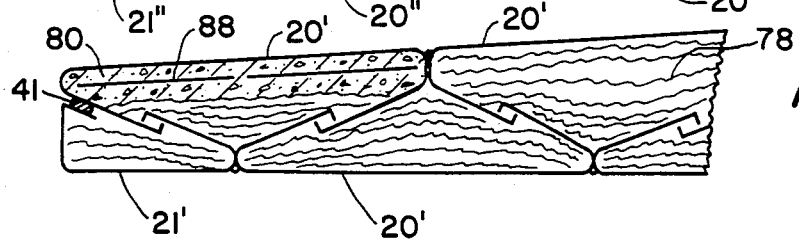
FIG. 29 is a fragmentary end view of a module similar to FIG. 28, showing panel elements having angular, inwardly extending baffle panels that are at acute angles to the respective inner and outer surfaces of the module.

FIGS. 28 and 29 show building modules that have nonparallel inner and outer wall surfaces, and are particularly suitable for use as combined ceiling and roof defining modules. In the FIG. 28 embodiment, substantially rectangular panel elements 20", 21", similar to those of FIG. 22, are employed, except that the end walls of the elements are progressively deeper in going from the outermost to the innermost portion of the module, relative to the interior and exterior of a building, from left to right as viewed in FIGS. 28 and 29. The FIG. 29 embodiment provides a ceiling-roof module formed from the basic panel elements illustrated in FIG. 19. Such modules can also be filled with insulation batts, concrete, gypsum, or the like, as desired. In each of the FIGS. 28 and 29 embodiment the respective compartments include different filler materials, for illustrative purposes only.

Figure 30:
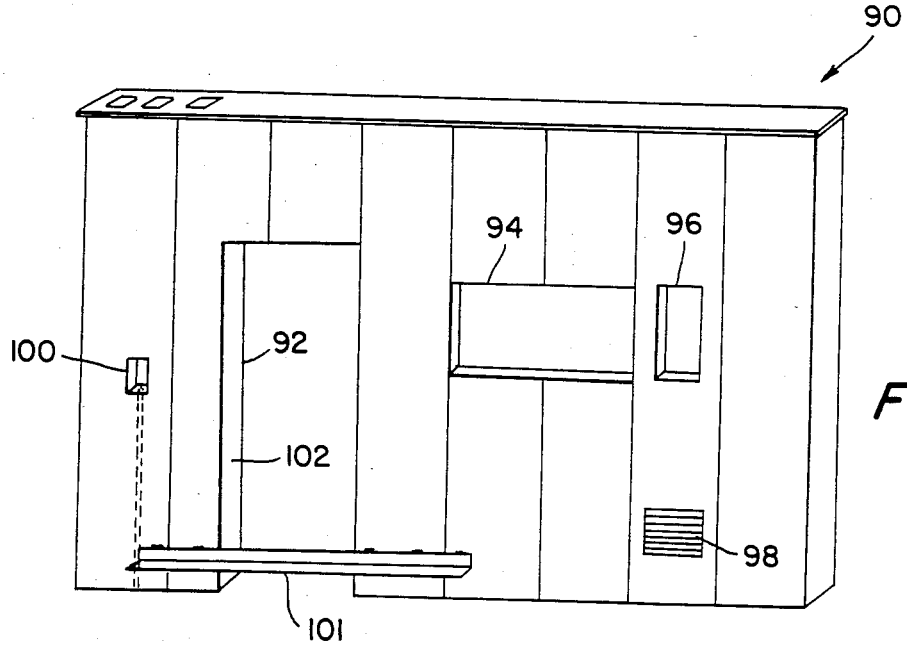
FIG. 30 is a perspective view, partially in phantom, showing a factory- assembled wall module using panel elements formed in accordance with the present invention.
Figure 31:
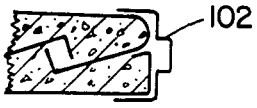
FIG. 31 is an enlarged, fragmentary end section showing the door jam structure for the door opening in the wall module of FIG. 30.

One possible type of wall module 90 that can be provided with the panel elements in accordance with the present invention is illustrated in FIGS. 30 and 31. Such a wall module can be assembled away from the building site and shipped to the side for immediate assembly with other modules. As shown, wall module 90 includes eight intermediate panel elements defining the wall faces and arranged end-to-end and welded together, and incorporates the specialized modules illustrated in FIGS. 9 through 11 and in FIGS. 13 through 16. Wall module 90 illustrated includes a doorway 92, two windows 94, 96 of different sizes, a ventilation outlet 98, and an electrical outlet box 100. An angle bar 101 can be provided to prevent distortion or twisting of the module during shipment, and it is intended to be removed when the module has been put in place.

As shown in FIG. 31, the door opening includes metal door jambs 102 that extend along the edges of the door openings, and that are welded to the ends of the adjacent panel elements.

Figure 32:
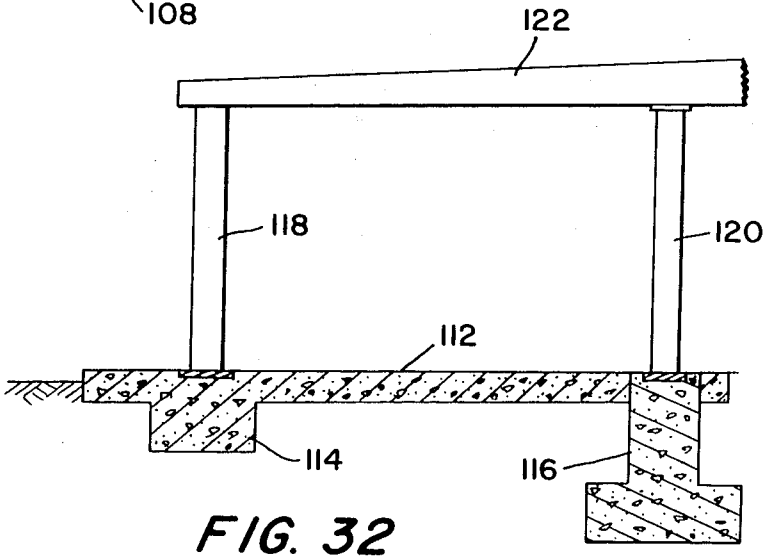
FIG. 32 is a fragmentary cross-sectional view of a single story building made from building modules formed in accordance with the present invention.

Referring now to FIG. 32, there is shown a sectional view of a portion of a building structure formed from modular panel elements of the type hereinabove described. The building illustrated is single story building that includes a concrete slab 112 and spaced footings 114, 116, or a foundation, to support the respective vertical wall modules 118, 120. An exterior wall is defined by module 118 and serves to support the outer end portion of a roof module 122, and one or more interior wall modules 120 can be positioned to define rooms, as well as to provide additional support for the inner portions of roof module 122.

Figure 34:
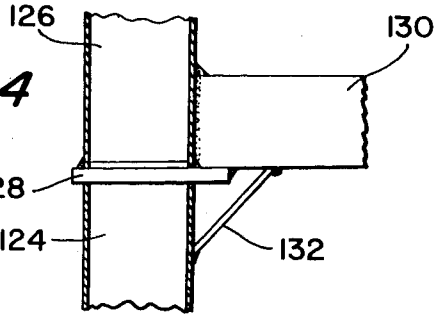
FIG. 34 is an enlarged, fragmentary cross-sectional view of the junction of first floor and second floor walls and an adjacent floor panel in the building illustrated in FIG. 33.
Figure 33:
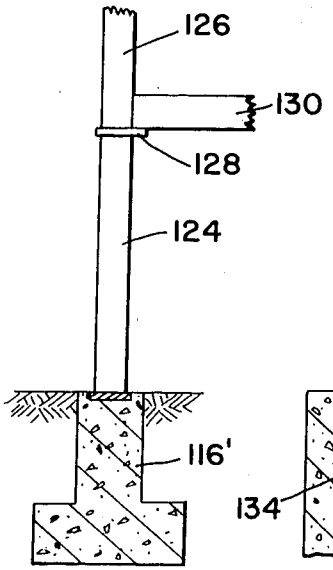
FIG. 33 is a fragmentary cross-sectional view showing the arrangement of building module elements in accordance with the present invention in a two story building.

In FIGS. 33 and 34, a portion of a multi-story building is illustrated, and shows the connections between a first floor wall module 124 and the adjacent second floor wall module 126, which as shown in FIG. 34 are separated by a support plate 128 welded to each of the wall modules. Support plate 128 extends inwardly beyond the inner surfaces of the inner walls to provide vertical support for a floor panel module 130. As shown, a diagonally positioned plate 132 can be welded to each of the first floor wall module 124 and the floor panel module 130 to conceal from view the inward projection of support plate 128.

Figure 35:
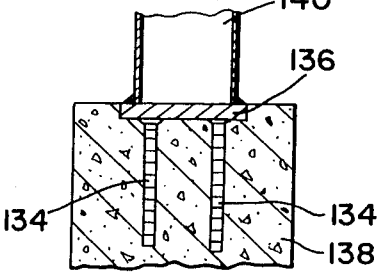
FIG. 35 is a fragmentary cross-sectional view showing a method of joining a first floor wall module to a building foundation.

The connection of the exterior or interior wall modules with the footings or foundation can be effected as illustrated in FIG. 35. As shown, anchor bars 134 are welded to a substantially horizontally extending support plate 136 with the bars 134 and plate 136 set into the concrete footing 138 before the concrete has hardened. The wall module 140 rests upon the support plate and is welded thereto.

Figure 36:
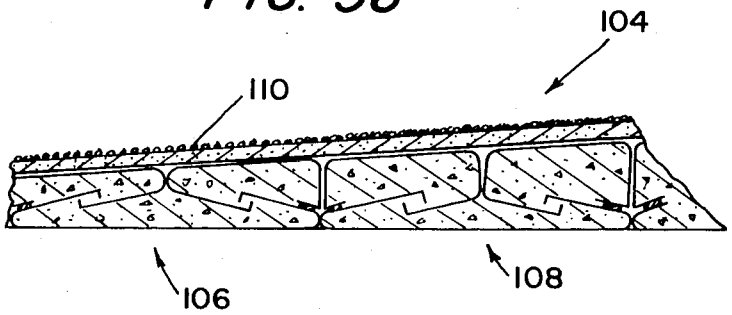
FIG. 36 is an enlarged, fragmentary cross-sectional view of a roof module made from building panel elements formed in accordance with the present invention.

A modular building roof 104, which can also be assembled off-site and shipped thereto for assembly with other modules, is illustrated in FIG. 36. As shown, each of the individual modules 106, 108 is a two-foot wide module, and the respective ends are of increasing height to provide a continuous sloping surface that can include a layer of a suitable roofing material 110 on the outwardly facing surface of the roof. The roofing material can be applied on-site.

Figure 37:
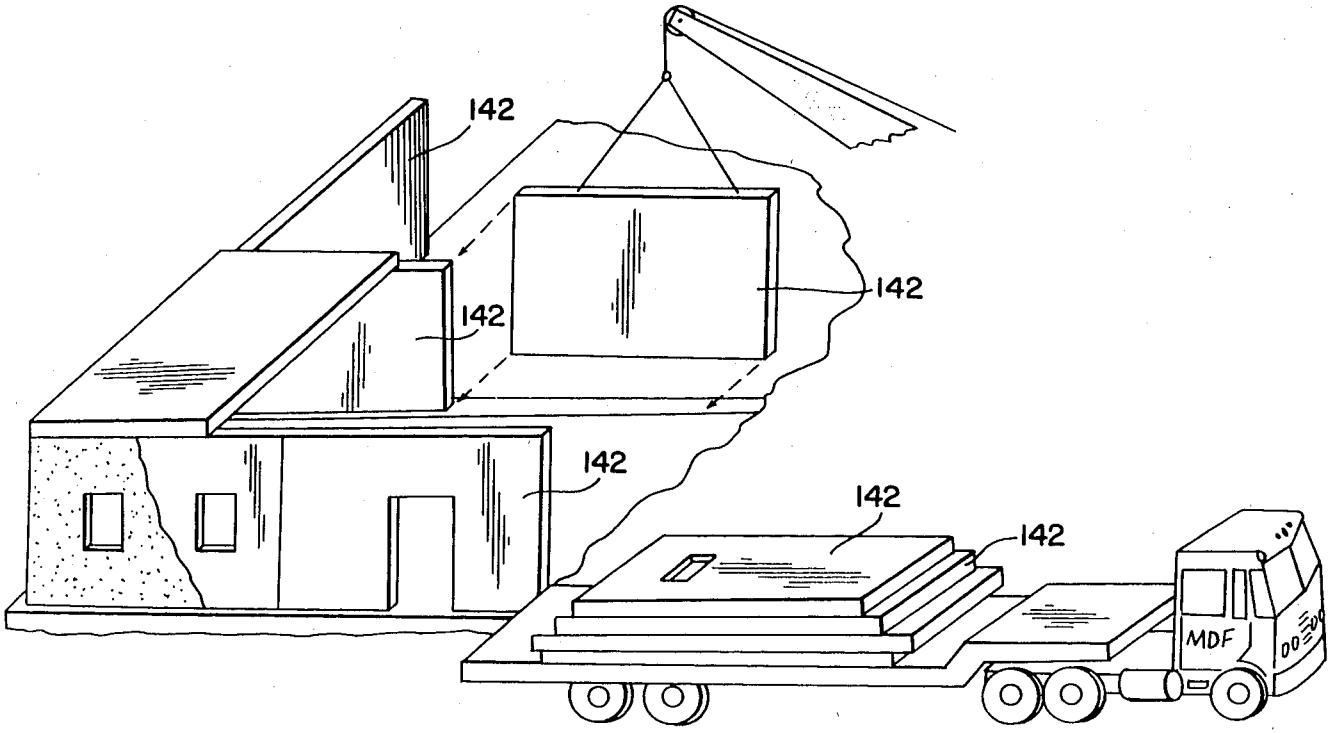
FIG. 37 is a perspective view of a portion of a building formed from prefabricated wall and roof or ceiling panels in the process of construction and wherein the prefabricated wall and roof modules are formed in accordance with the present invention.
Figure 38:
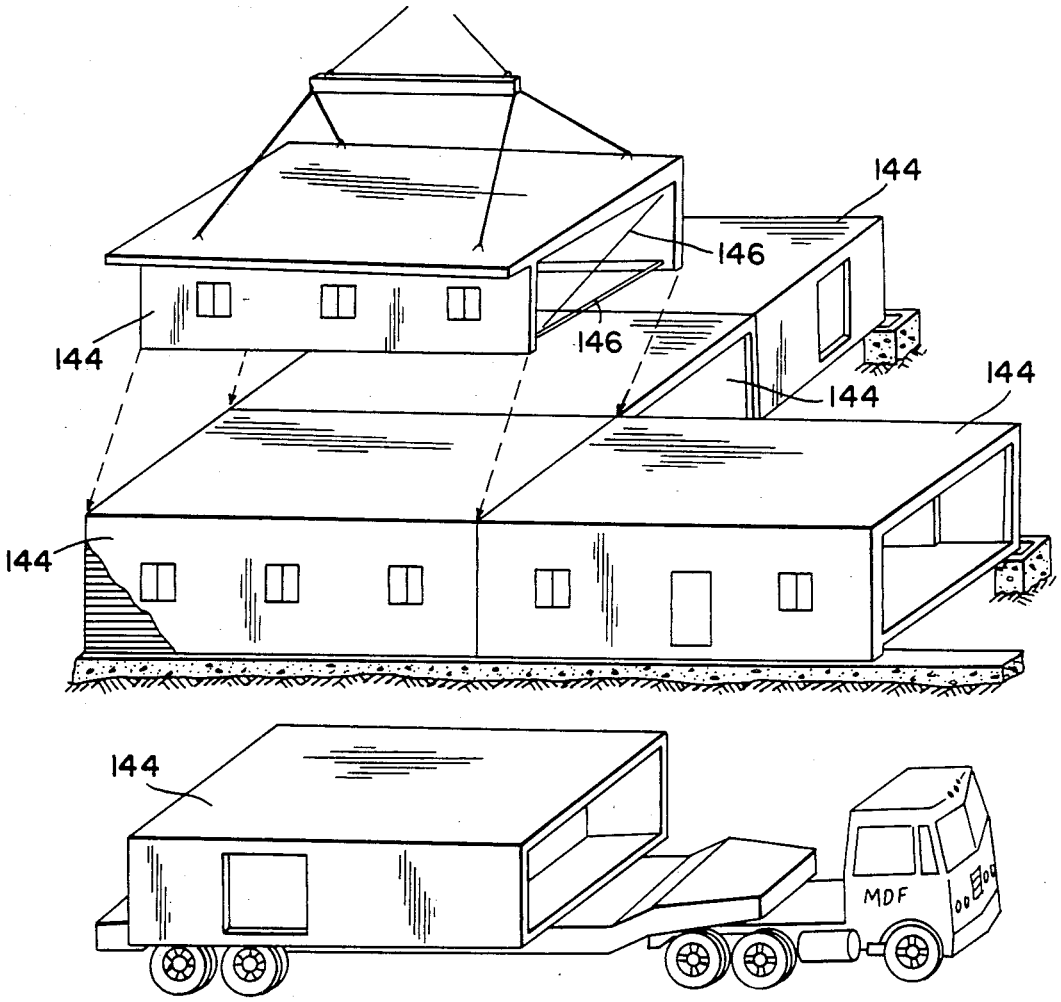
FIG. 38 is a perspective view of a portion of a building constructed using prefabricated room modules formed from panel elements in accordance with the present invention.

FIGS. 37 and 38 illustrate the adaptability of the present invention for forming prefabricated modules to facilitate the construction of buildings in a rapid manner. The respective prefabricated wall modules 142 illustrated in FIG. 37 are trucked to the building side from a manufacturing facility and are assembled in the desired relationship using a crane to carry the modules from the truck to their position in the building.

In FIG. 38, prefabricated room modules 144 are assembled off-site and are trucked to the building site for positioning next to and for stacking upon one another to provide the desired building structure. As shown, the lowermost room modules include both floors and ceilings connected with wall elements, whereas the upper floor modules include only ceilings connected to the wall elements, and also carry temporary bracing rods 146 or struts to support the vertical walls until the room modules are secured in position.

Figure 39:
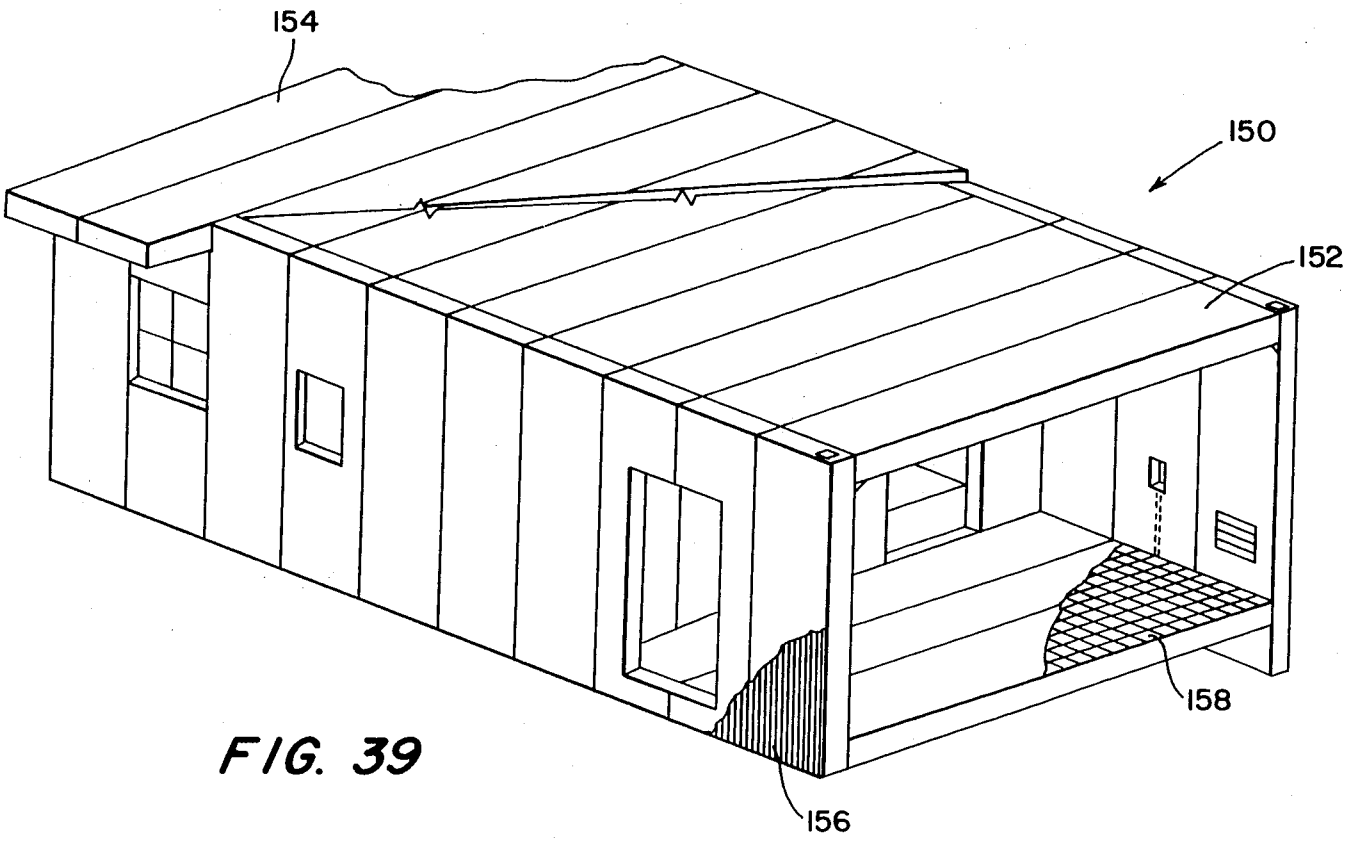
FIG. 39 is a fragmentary perspective view of a prefabricated room module similar to that illustrated in FIG. 38, and on an enlarged scale, with portions of the structure broken away to illustrate the construction of the room.

FIG. 39 shows an enlarged perspective view of a prefabricated room module 150 that can include a flat ceiling and floor module 152 or, alternatively, a slopping roof module 154 to define a roof and ceiling. FIG. 39 also illustrates the finishing alternatives that include siding 156, floor finishing materials 158, and the like, as desired. It can thus be seen that the panel elements in accordance with the present invention can be combined in various ways and with various filler materials to provide interior or exterior walls, floors and ceilings, or roofs and ceilings, and can accommodate any number of building requirements to provide complete versatility of building structure and appearance.

Although particular embodiments of the present invention have been illustrated and described it will be apparent to those skilled in the art that various changes and modifications can be made without departing from the spirit of the present invention. It is therefore intended to encompass within the appended claims all such modifications that fall within the scope of the present invention.

What is claimed is:

1. A building panel element for forming a part of a building wall surface, said element comprising;

(a) a generally rectangular metallic wall member having an inner wall surface and an outer wall surface, said wall member having a predetermined height and width and including longitudinally extending edges and laterally extending edges;

(b) a pair of laterally spaced baffle members each extending inwardly from respective ones of said longitudinal edges, at least one of said baffle members defining an acute angle with said inner wall surface; and (c) end flanges carried along longitudinally extending innermost edges of each of said baffle members and extending inwardly toward the inner wall surface of the panel element.

2. A building panel element in accordance with claim 1 formed from a sheet steel panel having a gauge of from about 26 to about 7.

3. A building panel element in accordance with claim 2, wherein the sheet gauge is from about 14 to about 12.

4. A building panel element as claimed in claim 1, wherein the outer wall surface is planar.

5. A building panel element as claimed in claim 1, wherein the baffles extend along the entire length of each of the longitudinal edges of the wall member.

6. A building panel element as claimed in claim 1, wherein the baffles are substantially planar.

7. A building panel element as claimed in claim 1, wherein the angles are between about 90° and about 12°.

8. A building panel element as claimed in claim 1, wherein each of said baffles is positioned at substantially the same acute angel relative to the inner wall surface.

9. A building panel element as claimed in claim 7, wherein the angles are less than about 45°.

10. A building panel element as claimed in claim 9, wherein the angles are less than about 30°.

11. A building panel element as claimed in claim 10, wherein the angles range from about 12° to about 30°.

12. A building panel element as claimed in claim 1, wherein said end flanges extend along substantially the entire length of the longitudinal edges of the baffle members.

13. A building panel element in accordance with claim 1, wherein the end flanges are positioned at an angle of from about 90° to about 15° relative to the baffle members.

14. A building panel element as claimed in claim 13, wherein the angle is substantially 90°.

15. A building panel element as claimed in claim 1, wherein the panel element is formed from a single metallic sheet and includes integral baffle members and flanges.

16. A building panel element as claimed in claim 15, wherein junctions between the baffle members and the wall member define angular edges.

17. A building panel element as claimed in claim 15, wherein junctions between the baffle members and the wall member are rounded.

18. A building panel element as claimed in claim 17, wherein the rounded junctions are circular arcs having a radius of about one-half inch.

19. A building panel element as claimed in 1, wherein each baffle is planar.

20. A building panel element as claimed in claim 1, wherein ech baffle is positioned at a different angle relative to the rectangular wall.

21. A building panel element as claimed in claim 20, wherein one baffle is at substantially a right angle to the outer wall surface.

22. A building panel module comprising;

(a) a pair of similarly configured end panel elements each including a first rectangular wall defining first inner and outer wall surfaces, said rectangular wall having a length and width, a baffle member extending from a first longitudinal edge of said wall and in overlying relationship with said first inner wall surface and inclined thereto at an acute angle, and an end wall extending from a second longitudinal edge of said first wall and in the same direction relative to said first inner wall surface as said baffle member, each of said baffle member and said end wall having longitudinal flanges that extend inwardly toward said first inner wall surface;

(b) at least one intermediate panel element including a second rectangular wall defining second inner and outer wall surfaces, a pair of laterally spaced, longitudinally extending baffle members connected to longitudinal edges of said second rectangular wall and in overlying relationship with said second inner wall surface and inclined toward each other at acute angles relative to said second inner wall surface, each of said baffle members having longitudinally extending flanges that extend inwardly toward said second inner wall surface;

(c) said pair of end panel elements and said at least one intermediate panel element positioned to define a panel module wherein said first and second inner wall surfaces are in spaced, opposed relationship to define a panel module interior and are substantially parallel to each other, said end panel elements disposed with corresponding first longitudinal edges in opposed relationship and with said end walls facing outwardly to define a portion of an end panel of said panel module, said first outer wall surfaces being substantially coplanar and defining at least a portion of a first module outer wall surface, and said second outer surface of said at least one intermediate panel defining at least a portion of a second module outer wall surface; and (d) end plate means secured to the longitudinal ends of said end panel elements and of said at least one intermediate panel element.

23. A wall panel module in accordance with claim 22, wherein at least two intermediate panel elements are positioned with their outer wall surfaces substantially coplanar and are welded together along opposed longitudinal edges to define said second module outer wall, said first and second module walls facing in opposite directions and spaced from each other to provide an interior space for a filler material, wherein alternate, opposed baffle members are substantially parallel to each other.

24. A wall panel module in accordance with claim 22, wherein said end walls are welded together adjacent the intersections of said baffles and said respective rectangular walls, and said module includes only one intermediate panel element positioned opposite to and spaced from said pair of end panel elements.

25. A wall panel module in accordance with claim 22, wherein said end panel elements are spaced from each other by at least one intermediate panel element and said end panel elements are welded to longitudinal edges of said intermediate element so that corresponding outer wall surfaces of said end panel elements and said intermediate panel element are substantially coplanar to define a first outer wall of said module.

26. A building panel module in accordance with claim 22, including sealing strip means positioned between opposed ends of adjacent endmost panel elements.

27. A building panel module in accordance with claim 22, including thermal insulation filler material positioned in the interior of said module.

28. A building panel module in accordance with claim 22, including rock fill positioned within said panel module.

29. A building panel module in accordance with claim 22, including concrete fill adjacent the first inner wall surface and filling less than the entirety of the space between the module outer wall surfaces, and thermal insulation adjacent said second inner wall surface and filling less than the entirety of the space between the module outer wall surfaces.

30. A building panel module in accordance with claim 22, including concrete fill material positioned interiorly of said module.

31. A building panel module in accordance with claim 29, including an armor plate positioned adjacent an inner wall surface of said module to define a reinforcing, ballistic-projectile-resistant intermediate wall.

32. A building panel module in accordance with claim 22, wherein said first and second outer walls are positioned at an acute angle relative to each other.

33. A building panel module having spaced, generally rectangular opposed face panels and having side and end surfaces, said panel module comprising:

(a) a pair of end panel elements defining end portions of the module, the end panel elements having planar, substantially rectangular face panels defining at least portions of the face panels of the module;

(b) at least one intermediate panel element including a planar, substantially rectangular face panel defining at least a portion of a face panel of the module;

(c) wherein the longitudinal length of the face panels of the end panel element is substantially equal to the longitudinal length of the face panel of the at least one intermediate panel element, and the width of the face panel of the end panel element is substantially one-half the width of the face panel of the at least one intermediate panel element; and (d) at least one end plate connected to corresponding longitudinal ends of said end panel elements and said at least one intermediate panel element.

34. A building panel module according to claim 33, wherein the face panels of each of the end panel elements defines part of the same face panel of the module.

35. A building panel module according to claim 33, wherein the face panel of one of the end panel elements defines part of one face panel of the module and the face panel of the other end panel element defines part of the other face panel of the module.

36. A building panel module according to claim 33, wherein each of the end panel elements and the at least one intermediate panel element include baffle members that extend into the interior of the module.

37. A building panel module according to claim 34, wherein an intermediate panel element is positioned between and is secured to each of the end panel elements to define one face of the module, and a pair of intermediate panel elements are secured in side-to-side relationship to define the other face of the module.

38. A building panel module according to claim 34, wherein a first plurality of intermediate panel elements are secured inside-by-side relationships and are positioned between and are secured to respective end panel elements to define the face of the module, and a second plurality of intermediate panel elemtns are secured in side-to-side relationships to define the other face of the module, said second plurality of panel elements being greater than said first plurality of panel elements by one intermediate panel element.

39. A building panel module comprising;

(a) a pair of similarly configured end panel elements each including a rectangular wall defining inner and outer wall surfaces, said rectangular walls having a length and width, a baffle member extending from a first longitudinal edge of said rectangular wall and in overlying relationship with said inner wall surface and inclined thereto to an acute angle, and an end wall extending from a second longitudinal edge of said first wall and in the same direction relative to said first inner wall surface as said baffle member, each of said baffle member and said end wall having longitudinal flanges that extend inwardly toward said inner wall surface;

(b) said pair of end panel elements positioned with their inner wall surfaces in opposed, spaced, substantially parallel relationship to define a panel module interior, said end panel elements disposed with their end walls spaced from each other and facing outwardly to define respective end panels of said panel module; and (c) end plate means secured to longitudinal ends of said end panel elements.

* * * * *